US008827844B2

(12) United States Patent
Pettersen Lien

(10) Patent No.: US 8,827,844 B2
(45) Date of Patent: Sep. 9, 2014

(54) FOOTBALLMASTER

(76) Inventor: Hans Børge Pettersen Lien, Langesund (NO)

( * ) Notice: Subject to any disclaimer, the term of this patent is extended or adjusted under 35 U.S.C. 154(b) by 0 days.

(21) Appl. No.: 14/110,920

(22) PCT Filed: Apr. 12, 2012

(86) PCT No.: PCT/NO2012/050064

§ 371 (c)(1),
(2), (4) Date: Oct. 11, 2013

(87) PCT Pub. No.: WO2012/141597

PCT Pub. Date: Oct. 18, 2012

(65) Prior Publication Data

US 2014/0031147 A1 Jan. 30, 2014

(30) Foreign Application Priority Data

Apr. 12, 2011 (NO) ..... 20110556
Oct. 5, 2011 (NO) ..... 20111355

(51) Int. Cl.

| | |
|---|---|
| ***A63B 69/00*** | (2006.01) |
| *A63B 71/02* | (2006.01) |
| *A63B 63/00* | (2006.01) |
| *A63B 57/00* | (2006.01) |

(52) U.S. Cl.

CPC ..... *A63B 69/00* (2013.01); *A63B 2210/50* (2013.01); *A63B 2071/026* (2013.01); *A63B 2063/001* (2013.01); *A63B 69/002* (2013.01); *A63B 69/0097* (2013.01); *A63B 2063/002* (2013.01); *A63B 2225/093* (2013.01); *A63B 57/0062* (2013.01); *A63B 63/00* (2013.01)

USPC ..... 473/422

(58) Field of Classification Search

USPC ..... 473/422, 189, 164, 163, 161, 160, 162; 273/123 R; D21/313

See application file for complete search history.

(56) References Cited

U.S. PATENT DOCUMENTS 1,759,156 A * 5/1930 Fish ..... 473/143
1,798,140 A * 3/1931 Byers ..... 473/184
1,875,198 A * 8/1932 Nagai ..... 473/20

(Continued)

FOREIGN PATENT DOCUMENTS

DE 9111323 U1 11/1991
DE 102005024833 A1 11/2006

(Continued)

OTHER PUBLICATIONS

Webpage download, Plastidip, 2002, http://www.plastidip.com/docs/plastidip_uv.pdf, 2 pages.*

(Continued)

*Primary Examiner* — Gene Kim
*Assistant Examiner* — M Chambers
(74) *Attorney, Agent, or Firm* — Oppedahl Patent Law Firm LLC

(57) ABSTRACT

A training apparatus for use in training football basic technique is disclosed, comprising one opening on each side of the apparatus being adapted to entrance angles for at least one rail guiding a ball in a loop from one opening to the other, and a wall adjustable in height as well as sideways is fixed between said openings, where both openings for the ball can be used as entrance/exit and vice versa.

15 Claims, 2 Drawing Sheets

(56) References Cited

U.S. PATENT DOCUMENTS

Figure 1:
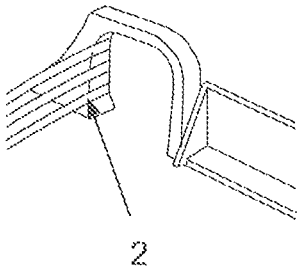

| | | | | | |
|---|---|---|---|---|---|
| 1,911,402 | A | * | 5/1933 | Scurlock | 473/184 |
| 1,961,060 | A | * | 5/1934 | McCarthy | 473/189 |
| 3,142,487 | A | | 7/1964 | Gold | |
| 3,180,643 | A | | 4/1965 | Oskar | |
| 3,342,495 | A | * | 9/1967 | Wasley | 473/164 |
| 3,365,199 | A | * | 1/1968 | Scholin et al. | 473/163 |
| 3,399,889 | A | * | 9/1968 | Harry | 473/481 |
| 4,124,210 | A | | 11/1978 | Mason | |
| 5,100,145 | A | * | 3/1992 | Kim | 473/160 |
| 5,524,900 | A | | 6/1996 | Allen | |
| 2004/0014537 | A1 | | 1/2004 | Piras | |
| 2004/0176193 | A1 | | 9/2004 | Valliquette | |
| 2007/0194534 | A1 | * | 8/2007 | Caruso | 273/407 |
| 2014/0031147 | A1 | * | 1/2014 | Pettersen Lien | 473/422 |

FOREIGN PATENT DOCUMENTS

| | | | |
|---|---|---|---|
| DE | 202007014952 | U1 | 3/2008 |
| GB | 2307646 | A | 6/1997 |
| GB | 2318299 | A | 4/1998 |

OTHER PUBLICATIONS

International search report in international patent application No. PCT/N02012/050064, dated Aug. 24, 2012.

International Preliminary Report on Patentability in international patent application No. PCT/N02012/050064, dated Jul. 12, 2013.

Norwegian search report in application No. NO 20111355 dated Oct. 31, 2011.

* cited by examiner

FOOTBALLMASTER

The invention relates to a training apparatus for use in training basic technique for ball games. The invention is generally applicable for all sorts of ball games, such as football, hockey, golf etc., but is in particular applicable for football, which is the ball game to be discussed in the following description.

In this context, basic technique for football is meant to comprise inside and outside passes along the ground with both legs, receiving and taking down the ball along the ground and in the air with both legs, keeper training of basic throwing and receiving the ball in the air, training sideways movement of the ball, and training of passes along the ground being measured by defined entrances being present which must be hit for the user again to receive the ball on the other side.

In connection with training apparatuses, games, units, tools and/or devices are known from prior art as stated hereinafter.

U.S. Pat. No. 3,142,487 A discloses a game where golf balls hit with exact precision are returned to the player for repeated play. The device has entrance for the ball, and exit.

DE 202007014952 U1 discloses a device having spatial target wall, i.e. football wall, consisting of a trapezoidal isoceles hollow body with a tubular shaped inner means in the size of a football. The inner means connects one inlet and one outlet through a slope. A tunnel attaches the openings in the wall with each other.

U.S. Pat. No. 4,124,210 A discloses golf putting practice apparatus being semi-circular and having flexible retaining walls. The outer wall is configurated in a semi-circle in surrounding relationship to the first wall and functions to retain golf balls that miss the keyhole cup.

U.S. Pat. No. 3,342,495 A discloses an indoor putting practice device which will accurately reveal when a ball is stroked too hard, for providing a putting practice device which will simulate condition of lateral slope on a putting green and to provide a device of the type described which is simple and inexpensive to manufacture and which may be folded into a compact package for shipment and storage.

DE 102005024833 A1 discloses ball game training apparatus comprising a ball linkage element that enables the direction vector of the played ball to be altered to enable vertical alteration of the ball.

GB 2318299 A discloses a football practice device comprising a vertical board with targets and an inclined board. The arrangement is such that a ball projected towards the device will rebound from the vertical board substantially horizontally and upwards, and thus enabling different skills to be practised from the same device. The targets may be holes covered with netting.

US 2004176193 A1 discloses a training device allowing the player to practice kicking at a rebound surface and then trap and return the rebounded ball. The device is lightweight and portable, thus enabling facilitated shipment and storage.

US 2004014537 A1 discloses a training tool for ball games allowing an optimal return of the ball itself and comprises: a frame defining a rebound area, ground anchoring means of said frame; elastic means defining a surface stretching on said rebound area, and positioning means of said frame according to the desired inclination.

GB 2307646 A discloses a device comprising a wall where a ball can bounce when using the device. The wall has a curved surface. The surface is an arc of a circle in vertical and horizontal sections and is rectilinear in horizontal direction.

U.S. Pat. No. 5,524,900 A discloses a ball re-bounding device for practising kicking of a football. The device includes a rebound panel for receiving a ball and directing the ball therefrom relative to an angle of incidence of the ball against the rebound panel.

In order to succeed as a footballer the basic technique is very important, and thus the object of the invention is to provide a training apparatus which will make the training of the basic technique more efficient and improved as the training apparatuses of today for training this in particular in a simple, effective, entertaining and measurable manner are not developed. The training apparatus according to the invention should be able to be used in organized training in for example athletic associations, schools, public welfares, etc., as well as in unorganized training or play where private individuals can use it any place appropriate therefor.

The apparatus is designed 1) for training of passes along the ground by training precision, training of effect of the pass, training of precision passes for right and left legs, training of precision passes when moving, and training precision passes when stationary, and 2) for training of receiving when shooting at a tilting wall in the case that the wall is designed for delivering different levels of height of the rebound depending upon where on the wall the ball is being hit, and with the force thereof.

The present invention relates to a training apparatus according to the appended claim 1, for use in training ball game basic technique, comprising one opening on each side of the apparatus being adapted to entrance angles and attachment means for at least one rail guiding a ball in a loop from one opening to the other, and a wall adjustable in height as well as sideways being fixed between said openings, where both openings for the ball can be used as entrance/exit and vice versa.

Figure 2:
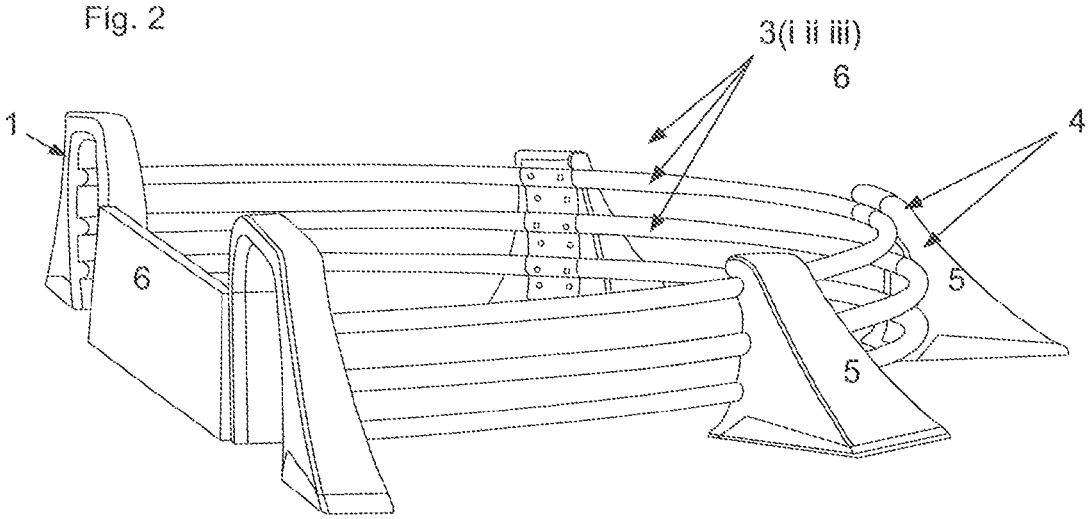
Figure 3:
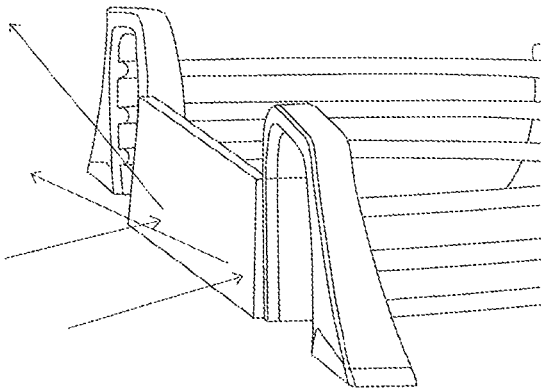

The invention and the embodiments thereof are explained more closely in the following by reference to the drawings, wherein:

FIG. 1 embodies an entrance/exit of a training apparatus according to the invention adapted to entrance angles and attachment of rails;

FIG. 2 embodies a training apparatus according to the invention in its entirety; and FIG. 3 embodies a wall as an integrated part of the training apparatus of FIG. 2 or as a detachable part which functions separately.

Figure 4:
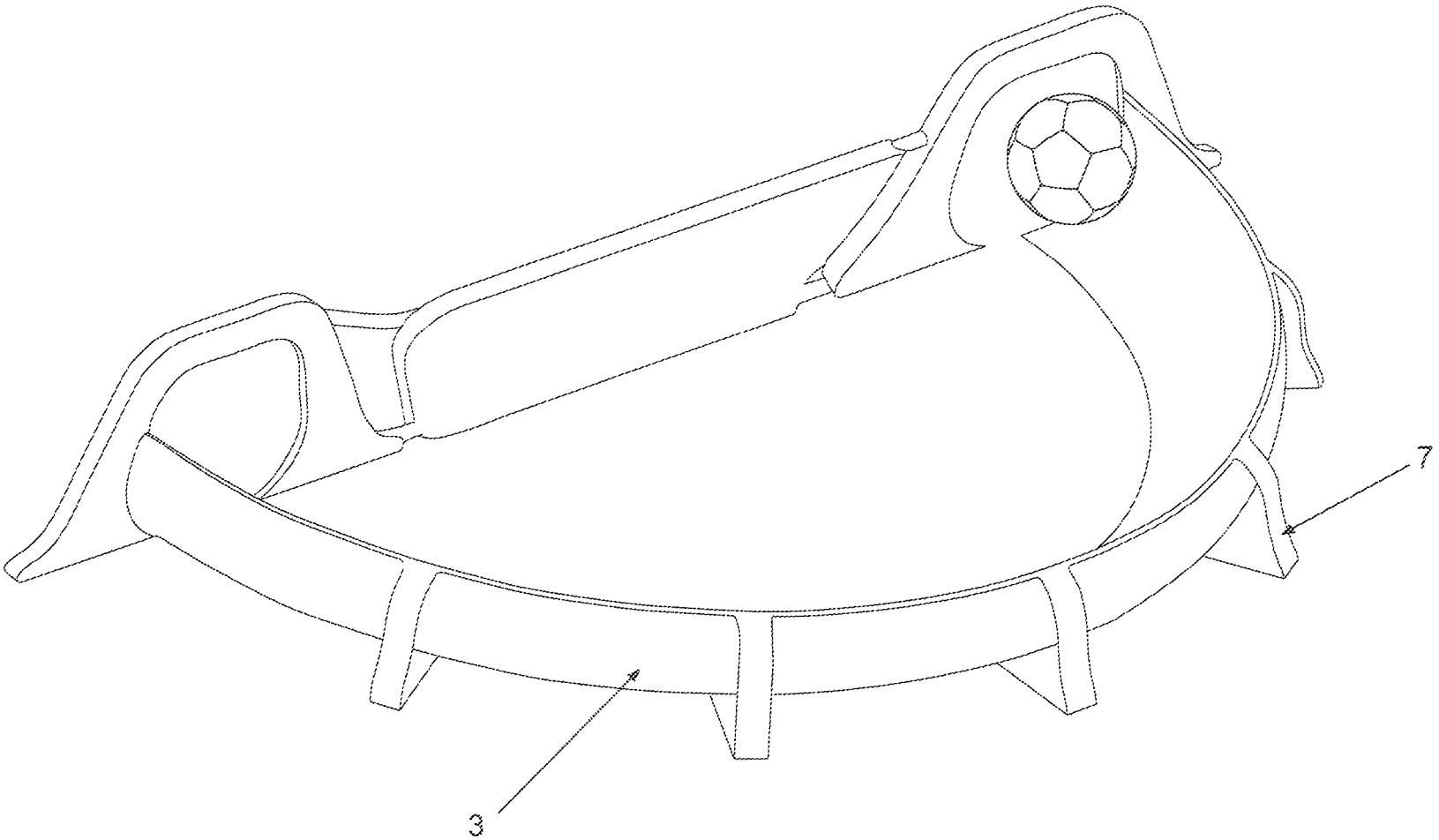

FIG. 4 embodies another variant of a training apparatus according to the invention in its entirety.

The apparatus has one opening 1 on each side being adapted to entrance angles and attachment means 2 of at least one rail, preferably three rails 3*i*, 3*ii*, 3*iii*, which are guiding the ball into a loop. The rails may be circular in cross section, as shown in the figures, and be made as rods or tubular members in metal or plastic or reinforced plastic or a combination thereof, such as plastic covered metal. The rails may also be made from a profile, such as an angular or T-shaped profile, in any suitable material such as aluminum or plastic, or even wood. The user can hit/strike the ball into the opening on one side and receive it on the other side. Both openings for the ball can be used in the present invention as entrance/exit and vice versa. Rail 3*i* has a sharper curvature than rails 3*ii* and 3*iii*, as embodied by reference numeral 4, for preventing the ball from jumping out of the loop. At least one bag 5, up to seven bags, preferably three bags, is/are provided, keeping the loop together and making it stable. They can be filled with water and/or sand or some other material for increasing the weight and stability of the apparatus, if required. Bag 5 can be provided with anti-gliding sole or similar for preventing gliding of the apparatus.

In accordance with FIG. 4, the apparatus has one opening 1 on each side being adapted to entrance angles and wherein the at least one rail 3 is comprised by one integral running rail guiding the ball into a loop. The rail 3 can be provided with at least one support leg 7 on the outer side in order to stabilize the apparatus against the surface on which the apparatus is placed. The rail 3 may be a separate part being detachably connected to the opening on each side of the apparatus, or alternatively the apparatus in its entirety may be manufactured in one piece also including the rail 3. The apparatus as embodied in FIG. 4 has similar characteristics as described herein and as shown in FIGS. 1-3.

The parts of the apparatus can be made from plastic and/or metal, but can also be made from different material, if required. By the very fact that the apparatus has one opening 1 on each side, this forces a precision of the user, and the user gets an immediate feedback of hit or not. When hitting, the user will get a good feeling. Between the openings 1 there is a tilting wall 6 which lifts the ball back in the air. The wall 6 is designed in such a way that it rebounds the ball at different angles depending on where on the wall 6 the ball is hitting, and by the hardness of the pass. The wall 6 is a detachable part of the training apparatus and can function separately or together with the apparatus in its entirety.

The wall 6 may also be realized as an elastic cord, web or net (not shown). If the cord, web or net is hit by a ball, the ball will bounce back. The level of skill required for using the apparatus may also be made variable by providing adjustable rails restricting the size of the openings 1. The openings may also be equipped with electronic equipment that counts the number of passes and measure speed of the ball and other measurements that will be relevant in the use of the equipment.

The training apparatus is primarily intended to be used for football, but the principle is also intended to be used for all ball sports that this type of training can be used for. Specifically, the apparatus may be made to fit hockey or other sports that will benefit from using this equipment. Thus, the apparatus may vary in width and length according to the sport that is intended to be played thereon. The apparatus can also be amended so that the principle will also prevail by use of a modified model standing on edge or being upright.

The invention claimed is:

1. A training apparatus for training basic ball game technique, the apparatus comprising: an opening (1) on each side of the apparatus, the opening adapted to entrance angles for at least one rail (3), the at least one rail positioned to guide a ball in a loop from one opening to the other, wherein the at least one rail (3) comprises one integral running rail or a number of individual rails (3*i*, 3*ii*, 3*iii*), wherein the rail or number of individual rails has/have a curvature adapted to prevent the ball from jumping out of the loop, wherein the curvature of the rail is shaper at an upper part of the rail than the curvature of the rail at a lower part of the rail or wherein the number of individual rails comprise an upper rail and a lower rail, the upper rail having a sharper curvature than the lower rail, the apparatus further comprising a wall (6) adjustably mounted between said openings (1) and creating a continuous barrier between said openings, the wall capable of being displaced in a vertical or lateral direction, where both openings (1) for the ball can be used as entrance/exit and vice versa.

2. The training apparatus according to claim 1, comprising at least one bag (5), preferably three bags, for supporting the rail (3) or rails as well as the apparatus itself.

3. The training apparatus according to claim 2, wherein the bag(s) is/are filled with water, sand or a combination thereof.

4. The training apparatus according to claim 3, wherein the wall (6) is detachable.

5. The training apparatus according to claim 3, wherein the apparatus is made from plastic, metal or any combination thereof.

6. The training apparatus according to claim 2, wherein the bag(s) is/are provided with an anti-gliding sole or similar device for preventing gliding of the apparatus.

7. The training apparatus according to claim 6, wherein the wall (6) is detachable.

8. The training apparatus according to claim 6, wherein the apparatus is made from plastic, metal or any combination thereof.

9. The training apparatus according to claim 1, comprising three rails (3*i*, 3*ii*, 3*iii*), an upper rail, a middle rail, and a lower rail, the upper rail (3*i*) having a sharper curvature than the middle and lower rails (3*ii*, 3*iii*).

10. The training apparatus according to claim 9, wherein the wall (6) is detachable.

11. The training apparatus according to claim 9, wherein the apparatus is made from plastic, metal or any combination thereof.

12. The training apparatus according to claim 2, wherein the wall (6) is detachable.

13. The training apparatus according to claim 2, wherein the apparatus is made from plastic, metal or any combination thereof.

14. The training apparatus according to claim 1, wherein the wall (6) is detachable.

15. The training apparatus according to claim 1, wherein the apparatus is made from plastic, metal or any combination thereof.

* * * * *